US011007564B2

(12) United States Patent
Michi et al.

(10) Patent No.: US 11,007,564 B2
(45) Date of Patent: May 18, 2021

(54) METHOD AND DEVICE FOR THICKENING A PLASTICALLY DEFORMABLE HOLLOW BODY WALL OF A HOLLOW BODY, IN PARTICULAR IN PORTIONS, AND MANUFACTURING METHOD AND MACHINE FOR PRODUCING A HOLLOW BODY

(71) Applicant: FELSS SYSTEMS GMBH, Koenigsbach-Stein (DE)

(72) Inventors: Werner Michi, Oelbronn-Duerrn (DE); Joerg Wachter, Keltern (DE); Dennis Beihofer, Kaempfelbach (DE); Philipp Grupp, Neulingen (DE); Michael Marre, Karlsruhe (DE)

(73) Assignee: FELSS Systems GmbH, Koenigsbach-Stein (DE)

( * ) Notice: Subject to any disclaimer, the term of this patent is extended or adjusted under 35 U.S.C. 154(b) by 356 days.

(21) Appl. No.: 15/860,878

(22) Filed: Jan. 3, 2018

(65) Prior Publication Data

US 2018/0185901 A1 Jul. 5, 2018

(30) Foreign Application Priority Data

Jan. 5, 2017 (EP) ..... 17150435

(51) Int. Cl.
*B21J 9/06* (2006.01)
*B21J 9/20* (2006.01)
(Continued)

(52) U.S. Cl.
CPC ..... *B21J 9/06* (2013.01); *B21J 5/025* (2013.01); *B21J 5/08* (2013.01); *B21J 9/20* (2013.01); *B21K 1/063* (2013.01); *B21K 21/12* (2013.01)

(58) Field of Classification Search
CPC ..... B21J 5/08; B21J 9/06; B21J 5/022; B21J 5/025; B21J 5/02; B21K 21/00; B21K 21/04; B21K 21/08; B21K 21/12
(Continued)

(56) References Cited

U.S. PATENT DOCUMENTS 1,393,916 A * 10/1921 Smith ..... B21J 5/08 72/427
2,344,285 A * 3/1944 Cormode ..... B21J 9/08 72/354.6
(Continued)

FOREIGN PATENT DOCUMENTS

CN 101263308 A 9/2008
CN 104302417 A 1/2015
(Continued)

OTHER PUBLICATIONS

Indian Office Action dated Jan. 16, 2020 issued in the corresponding Indian Application 201734046572.
(Continued)

*Primary Examiner* — Adam J Eiseman
*Assistant Examiner* — Dylan Schommer
(74) *Attorney, Agent, or Firm* — Collard & Roe, P.C.

(57) ABSTRACT

A method for thickening a plastically deformable hollow body wall of a hollow body includes the steps of arranging the hollow body in an outer mold, arranging an inner supporting body inside the hollow body, applying a compressive force to the hollow body wall by means of two application members moving towards one another in an axial direction with a continuous compressing movement, and performing an axial relative movement of the application members performing the continuous compressing movement on the one hand and of the outer mold on the other hand. Due to the compressing movement of the
(Continued)

application members, material of the hollow body wall is plasticized and flows into an expansion space of the outer mold, an axial extent of the expansion space increasing due to the axial relative movement of the application members performing the continuous compressing movement and of the outer mold.

13 Claims, 12 Drawing Sheets

(51) Int. Cl.

| | |
|---|---|
| ***B21J 5/08*** | (2006.01) |
| ***B21J 5/02*** | (2006.01) |
| ***B21K 1/06*** | (2006.01) |
| ***B21K 21/12*** | (2006.01) |

(58) Field of Classification Search
USPC ..... 72/348, 370.01–370.03, 370.1, 352, 72/353.2, 354.6, 358, 359
See application file for complete search history.

(56) References Cited

U.S. PATENT DOCUMENTS

| | | | | | |
|---|---|---|---|---|---|
| 3,224,243 | A * | 12/1965 | Van Deberg | B21K 21/12 | 72/359 |
| 6,082,166 | A * | 7/2000 | Marin | B21D 45/06 | 72/348 |
| 7,950,153 | B2 * | 5/2011 | Dohmann | B21J 5/12 | 29/893.34 |
| 2003/0019269 | A1 * | 1/2003 | Rolf | B21K 1/063 | 72/85 |
| 2006/0260115 | A1 * | 11/2006 | Otaki | B21J 5/08 | 29/505 |
| 2013/0040161 | A1 | 2/2013 | Gerlach et al. | | |
| 2016/0001351 | A1 | 1/2016 | Gunther et al. | | |

FOREIGN PATENT DOCUMENTS

| | | | | | |
|---|---|---|---|---|---|
| DE | 439258 | | | 1/1927 | |
| GB | 561900 | A | * | 6/1944 | B21J 9/06 |
| JP | 57-165155 | | | 10/1982 | |
| JP | 57165155 | A | * | 10/1982 | B21K 23/04 |
| JP | S57165155 | A | * | 10/1982 | |
| JP | 58163542 | A | * | 9/1983 | B21J 5/08 |
| JP | 59088210 | A | * | 5/1984 | B23D 79/02 |
| JP | 2000-71043 | | | 3/2000 | |
| JP | 2000140991 | A | | 5/2000 | |
| JP | 2012-45565 | | | 3/2012 | |
| WO | 2006080503 | A1 | | 8/2006 | |
| WO | WO-2011113556 | A1 | * | 9/2011 | B21J 9/022 |

OTHER PUBLICATIONS

Korean Office Action dated Apr. 29, 2020 issued in the corresponding Korean Application 10-2018-0000318.
European Office Action dated Sep. 8, 2020 issued in the corresponding European Application 17 150 435.0 (with English translation of relevant parts).
Chinese Office Action/Search Report dated Sep. 24, 2019 (with English translation of relevant parts).
Japanese Office Action dated Oct. 15, 2019 (with English translation of relevant parts).

* cited by examiner

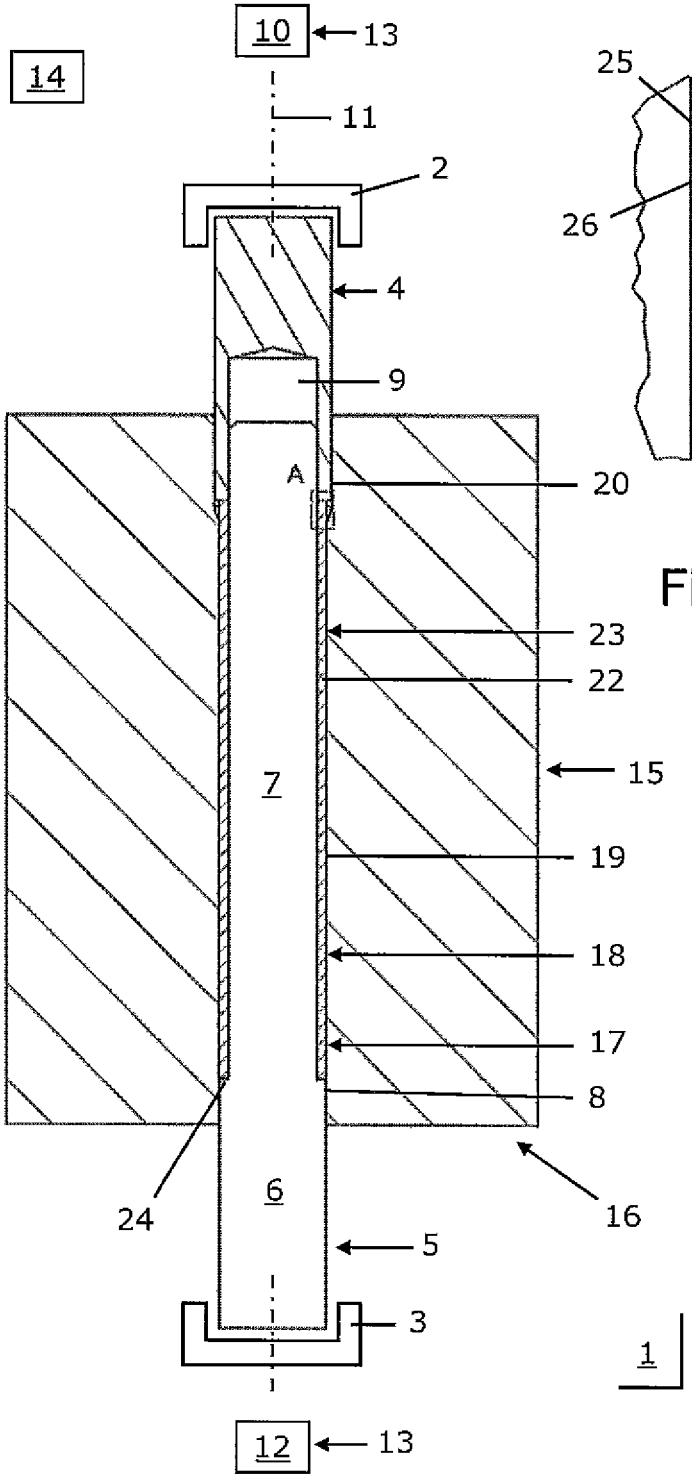
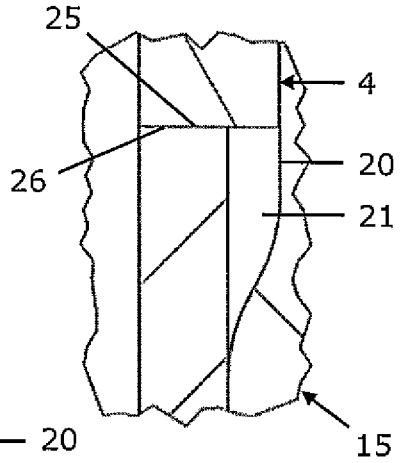
Fig. 1B
Fig. 1A

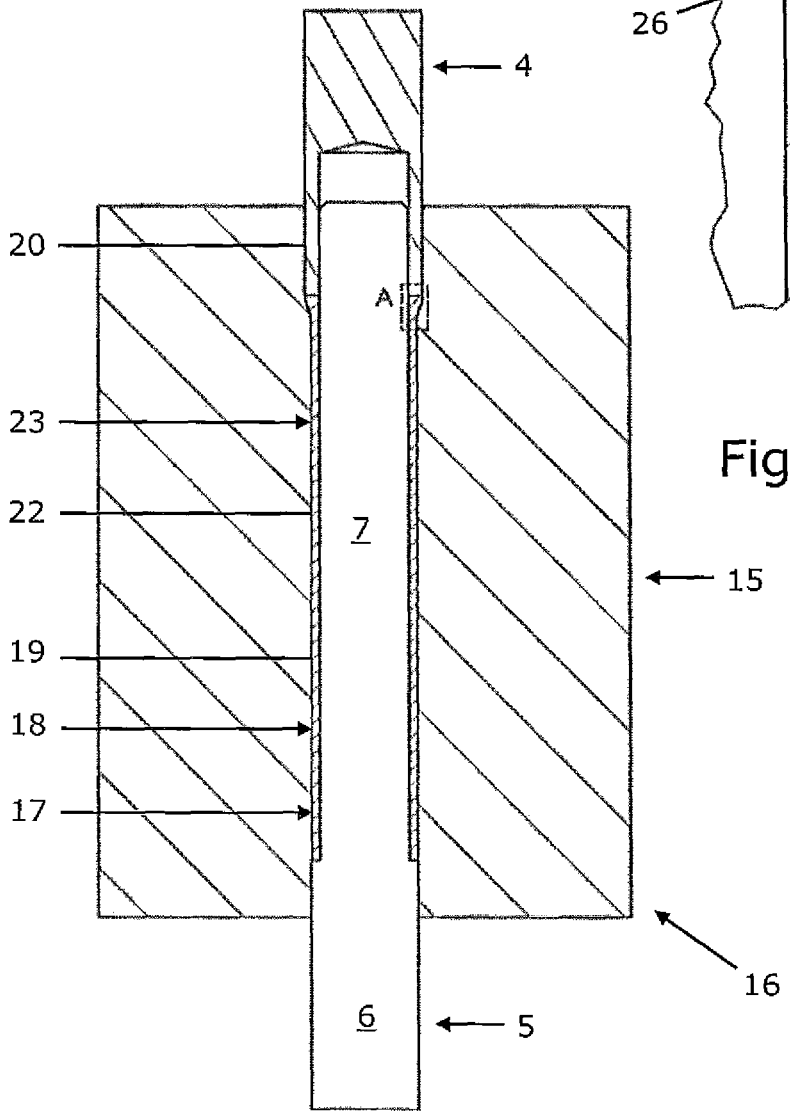
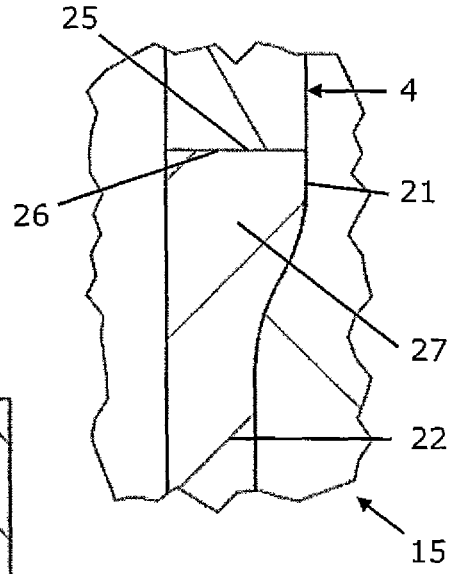
Fig. 2B
Fig. 2A

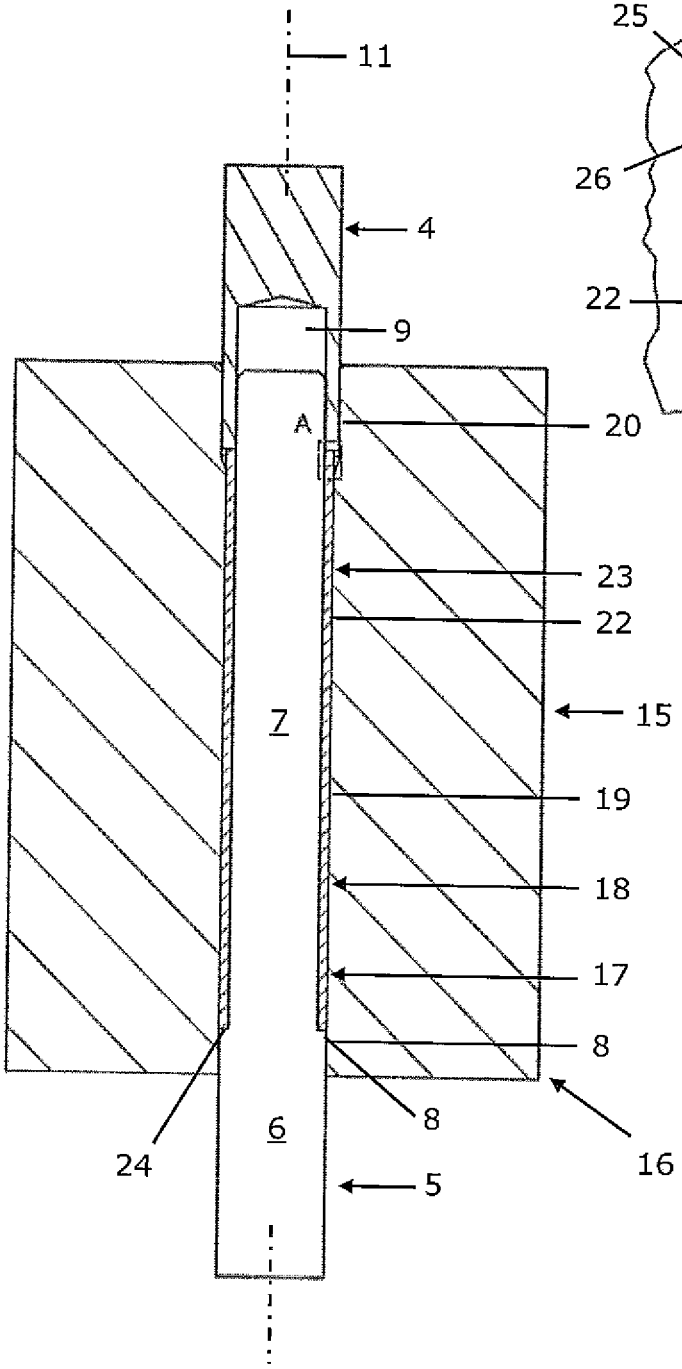
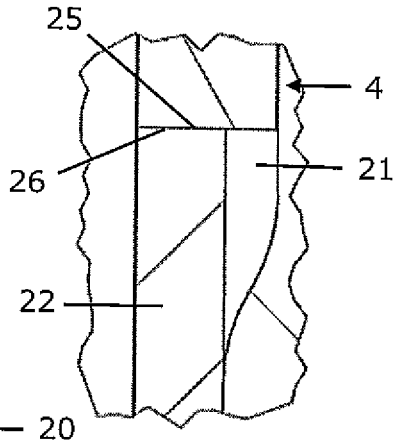
Fig. 5B
Fig. 5A

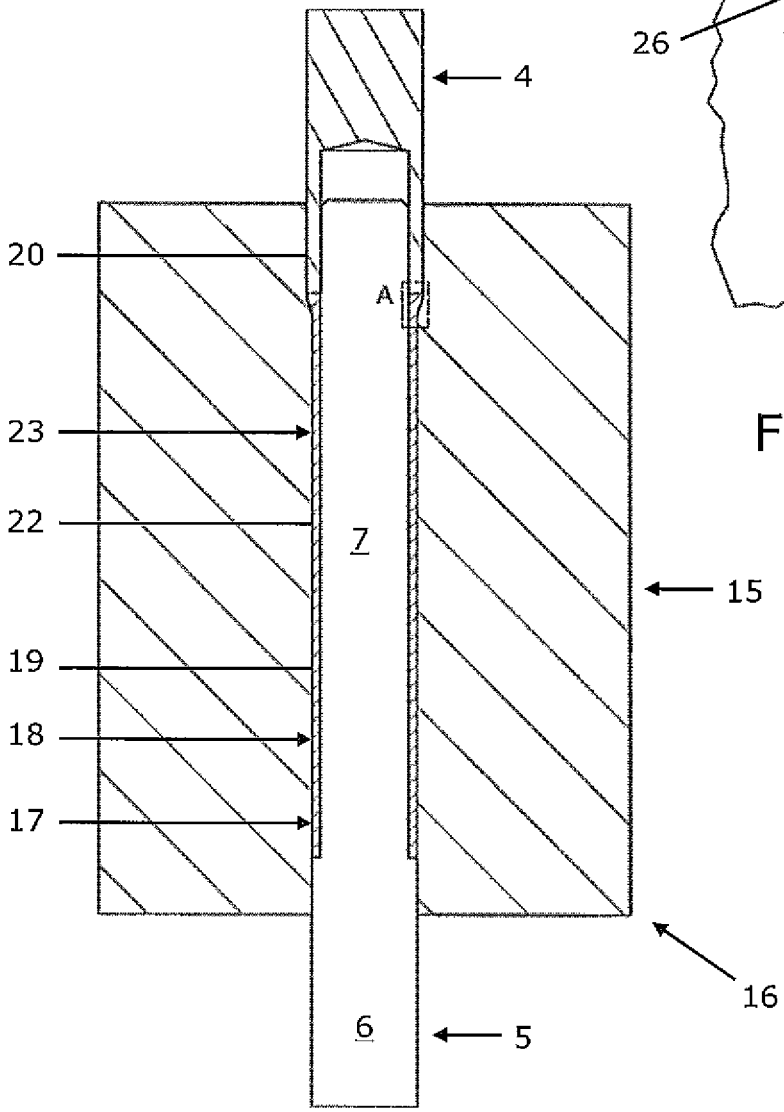
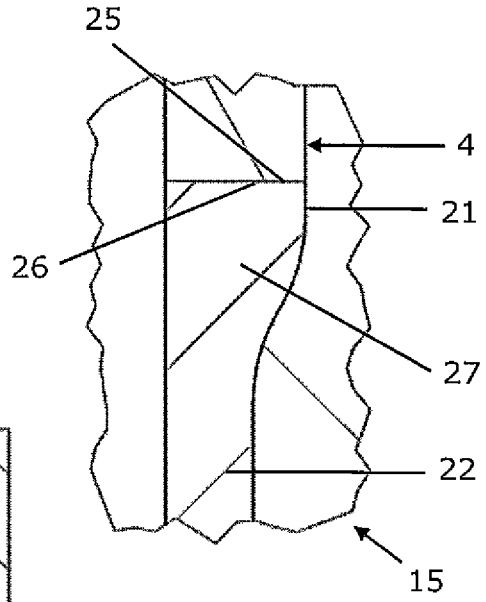
Fig. 6B
Fig. 6A

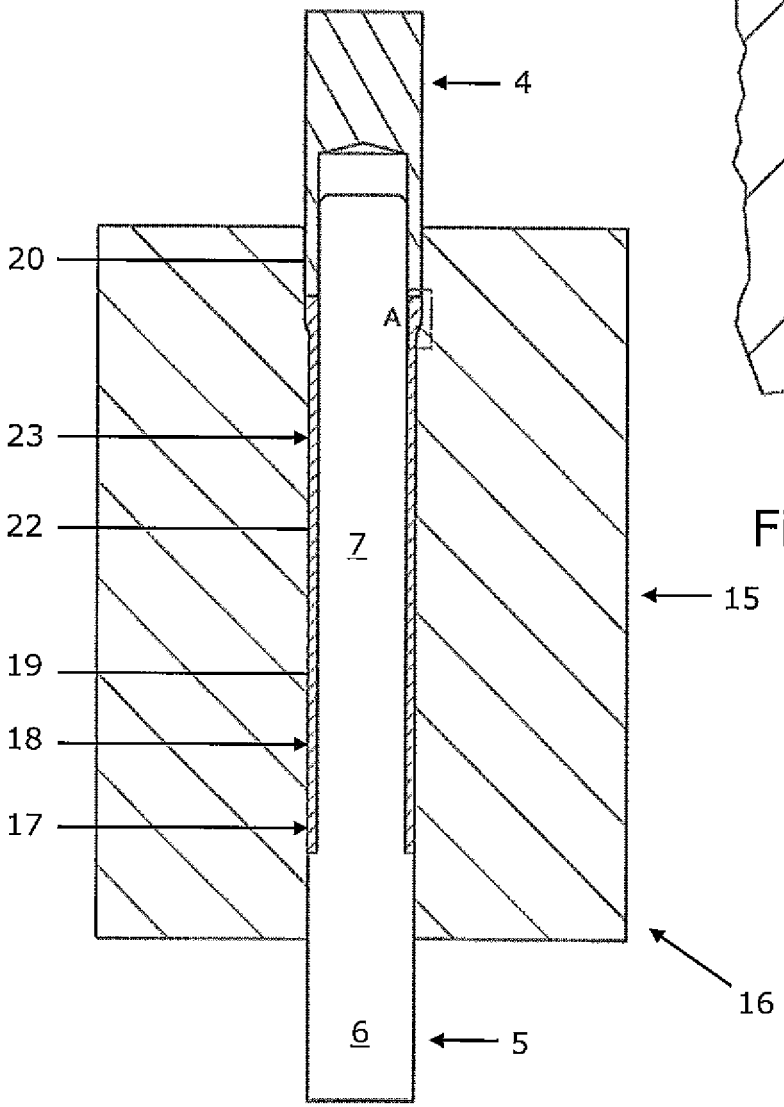
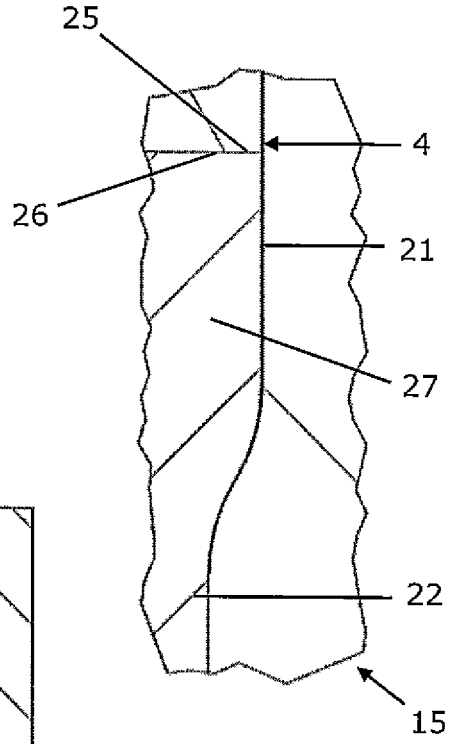
Fig. 7B
Fig. 7A

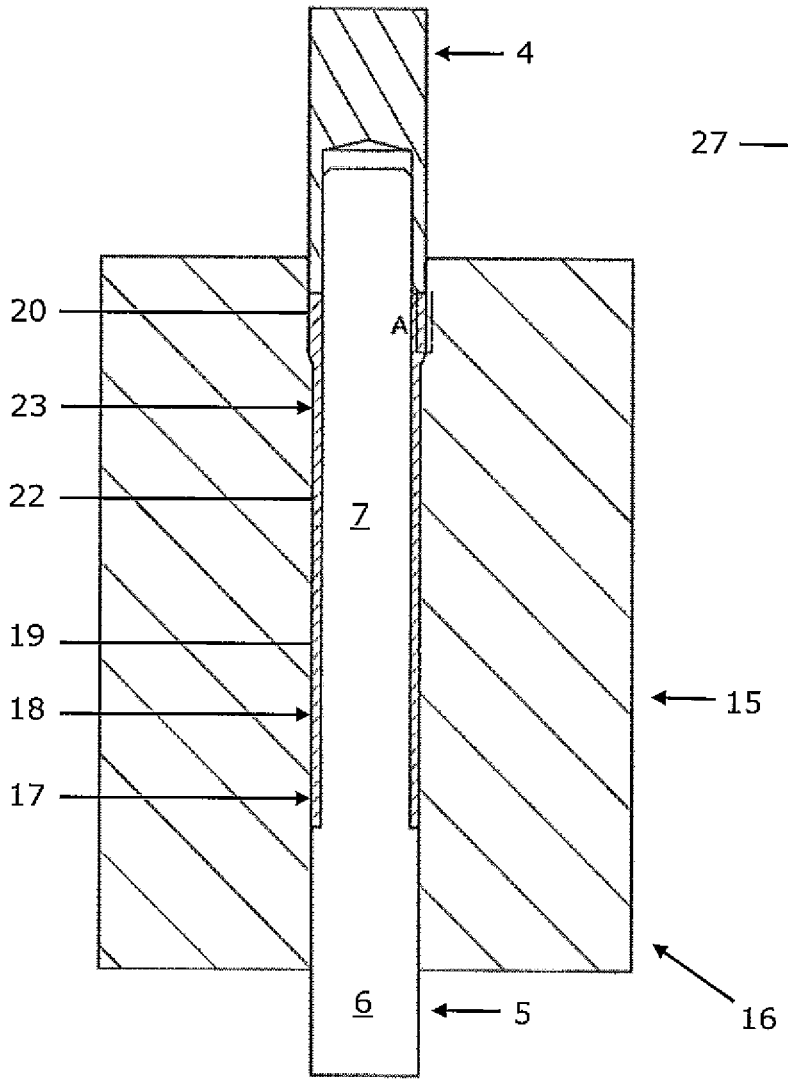
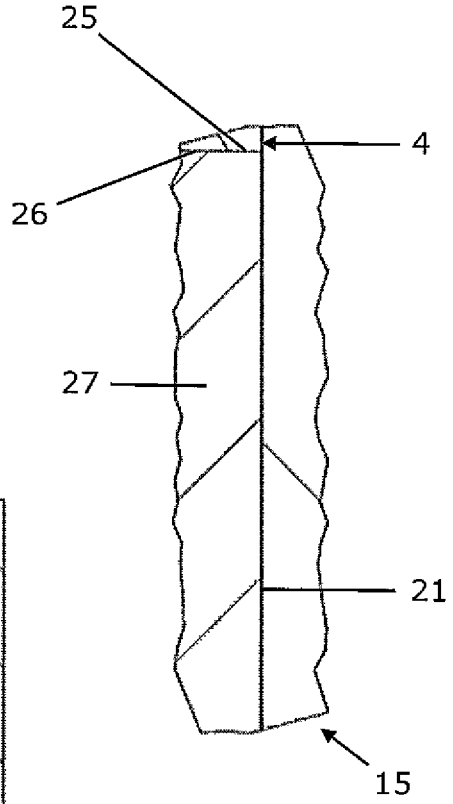
Fig. 8B
Fig. 8A

METHOD AND DEVICE FOR THICKENING A PLASTICALLY DEFORMABLE HOLLOW BODY WALL OF A HOLLOW BODY, IN PARTICULAR IN PORTIONS, AND MANUFACTURING METHOD AND MACHINE FOR PRODUCING A HOLLOW BODY

CROSS REFERENCE TO RELATED APPLICATIONS

This application claims priority under 35 USC 119 of European Patent Application No. 17 150 435.0 filed on Jan. 5, 2017, the disclosure of which is herein incorporated by reference.

BACKGROUND OF THE INVENTION

The invention relates to a method and a device for thickening a plastically deformable hollow body wall of a hollow body, in particular in portions, the hollow body wall extending in an axial direction along a cavity axis of a cavity, delimited by the hollow body wall, of the hollow body.

The invention also relates to a manufacturing method for producing a hollow body, within which method the above-mentioned method is used, and to a machine for producing a hollow body, which machine comprises a device of the above-mentioned type.

The need to thicken a hollow body wall of a hollow body exists for example in cases in which the hollow body wall must have an increased rigidity at least in a portion and/or in cases in which a specific region of the hollow body wall is to be provided with particular functional elements, for example with a toothing or with a thread. Hollow bodies of this kind are hollow shafts for example, as are used in automotive engineering as drive shafts, more specifically as side shafts inter alia.

Methods and devices by means of which axial portions of different wall thickness are produced on hollow shafts by reducing the thickness of the wall of a shaft blank in an axial portion, whilst maintaining the original wall thickness in another axial portion of the shaft blank, are currently customary. In some cases, cold forming methods, for example rotary swaging, can be used.

SUMMARY OF THE INVENTION

The object of the present invention is that of providing alternative methods and devices for thickening of a plastically deformable hollow body wall of a hollow body, in particular in portions, and for producing a hollow body having a hollow body wall that is thickened in particular in portions.

In the case of the invention, material is selectively accumulated on a hollow body wall. For this purpose, the hollow body in question is arranged with the as yet unthickened hollow body wall in a receptacle of an outer mold. The receptacle of the outer mold has a receptacle wall, which extends in the axial direction on the outer side of the hollow body wall arranged in the receptacle. A first partial length of the receptacle wall extends close to the hollow body wall in parallel therewith and forms an outer supporting face for the unthickened hollow body wall. A second partial length of the receptacle wall is offset radially outwardly relative to the first partial length of the receptacle wall, thus widening the receptacle, and delimits an expansion space of the outer mold formed due to, the offset. An inner supporting body is arranged on the inner side of the unthickened hollow body wall in such a way that it forms an inner supporting face for the hollow body wall by means of a supporting body face extending on the inner side of the hollow body wall in the axial direction, in particular in parallel with the hollow body wall. In this case, the inner supporting body and the inner supporting face provided thereon are, in the axial direction, both at the level of the outer supporting face and at the level of the expansion space of the outer mold. With the resultant relative arrangement of the hollow body or the hollow body wall on the one hand and of the outer mold and the inner supporting body on the other hand, the hollow body is acted on by a compressive force by means of two application members at application points, in each case in the axial direction, by the application members being moved towards one another in the axial direction with a compressing movement. The application points on the hollow body are distanced from one another in the axial direction, and the expansion space of the outer mold is arranged between the application points. Under the action of the compressing movement of the application members, material of the hollow body wall between the application points is plasticised in the region of the expansion space of the outer mold, and plasticised material of the hollow body wall flows into the expansion space of the outer mold, thus thickening the hollow body wall. At the same time, the inner supporting body preferably ensures that the cross section of the cavity delimited by the hollow body wall remains substantially unchanged, in particular at the level of the expansion space of the outer mold.

The method according to the invention can in particular be a cold forming method. Hollow bodies made of any plastically deformable materials, in particular hollow bodies that comprise at least walls made of plastically deformable metal, are formed.

For example, a mandrel is a potential inner supporting body, and punches are potential application members. In particular, a controllable hydraulic drive can be provided as motor drive for generating the compressing movement of the application members. However, other controllable drive designs are also conceivable.

The motor drive of the application members preferably comprises two drive units, each of which being associated with one of the application members and which are controlled in a mutually coordinated manner, for example by means of a numerical control. The numerical control for the application members can be integrated in a superordinate device control or tool control or in a superordinate machine control.

The hollow body to be formed is preferably open at least at one end in the axial direction. Depending on the position that the expansion space of the outer mold assumes in the axial direction relative to the hollow body wall that is to be thickened, different axial portions of the hollow body wall can be thickened in the described manner. It is equally possible to thicken the hollow body wall at one or both ends arranged in the axial direction and to thicken an axial portion of the hollow body wall distanced from the axial ends.

Various possibilities are used according to the invention in a supplementary manner or alternatively in order to generate the compressing movement of the application members. More specifically, it is provided that one of the application members is moved by means of appropriate control of the motor drive of the application members towards the other application member, which is stationary in the axial direction, and/or that both application members are moved simultaneously and in opposite directions in the axial direction, and/or that both application members are moved simultaneously and in the same direction and at different speeds in the axial direction. In each case, the distance between the application members in the axial direction is reduced and pressure is applied to the hollow body wall, which is plasticised in a region arranged between the application points. The plasticised material of the hollow body wall is prevented from escaping into the interior of the cavity by the inner supporting body and consequently flows into the expansion space of the outer mold arranged on the outer side of the hollow body wall, thus thickening the hollow body wall.

In a development of the invention, it is possible by appropriate control of the motor drive of the application members to generate a continuous compressing movement and/or an intermittent compressing movement of the application members. A continuous compressing movement is associated with a continuous material flow, and an intermittent compressing movement is associated with an intermittent material flow into the expansion space of the outer mold.

According to the invention, the compressing movement or the motor drive of the application members can be path-controlled and/or force-controlled. In particular, a combination of path control and force control is possible.

In case of path control of the compressing movement, the path length over which the application members are moved towards one another in the axial direction in order to plasticise material of the hollow body wall that is to be formed can be predefined. A basis for the force control of the compressing movement can be the magnitude of the forming force introduced, by means of the application members, into the hollow body wall that is to be formed. If the magnitude of the forming force exceeds a predefined limit value, the compressing movement of the application members can be ended by appropriate control of the motor drive of the application members. For example, the predefined limit value of the forming force is exceeded as soon as the expansion space of the outer mold is completely filled with plasticised material of the hollow body wall, and consequently no further plasticised wall material can flow into the expansion space under the action of the pressure exerted by the application members onto the hollow body wall. If it is possible to enlarge the expansion space, an enlargement of the expansion space can be initiated when the limit value of the forming force is reached or just before said limit value is reached, thus creating a precondition for further plasticised wall material to be able to flow into the expansion space.

Both the path length to be defined in the case of path-controlling the compressing movement and the limit value of the forming force in the case of force-controlling the forming process can be determined in particular empirically.

In principle, it is possible to act on the hollow body with mutually opposing compressive forces at arbitrary points along the cavity axis of the cavity that is delimited by the hollow body wall. Applying pressure to the hollow body at least at one of the end radial faces of the hollow body, in particular of the hollow body wall, said faces being easily accessible for the forming device, is preferred according to the invention.

In the interest of a design of the device according to the invention for thickening the hollow body wall that is as compact as possible, it is provided that the hollow body is acted on in the axial direction by a compressive force by means of an application member formed in one piece with the inner supporting body.

If one of the application members is formed as a hollow member and is provided with a member cavity extending in the axial direction, the inner supporting body can enter the member cavity of the application member in question during the compressing movement of the application members. If the cross section of the member cavity and the cross section of the inner supporting body are mutually coordinated and if the application member cooperating with the hollow member is formed in one piece with the inner supporting body, the two application members are guided relative to one another in the axial direction during the compressing movement by the inner supporting body received in the member cavity.

In a further preferred embodiment of the invention, the hollow body is acted on in the axial direction by an application member which protrudes radially outwardly relative to the outer side of the hollow body wall and delimits the expansion space of the outer mold in the axial direction. In this case, in particular force control of the compressing movement of the application members can be provided. If, due to the compressing movement of the application members, material of the hollow body wall is plasticised and fed to the expansion space of the outer mold to such an extent that the expansion space of the outer mold is filled completely with plasticised wall material, a continued application of pressure to the hollow body wall by the application members causes a rise in pressure or a rise in the forming force exerted by the application members, which signals to the control of the motor drive of the application members that thickening the hollow body wall is currently completed.

If an application member delimits the expansion space of the outer mold in the axial direction, the axial extent of the expansion space can be changed, in particular increased, by means of a relative movement, performed in the axial direction, of the relevant application member and of the outer mold.

In a development of the invention, an axial relative movement of the application members and of the outer mold is performed in the axial direction in addition to the compressing movement of the application members. The axial extent of the thickening produced at the hollow body wall can be defined by the magnitude of the axial relative movement of the application members and the outer mold. The axial relative movement of the application members and of the outer mold is preferably also performed by a controlled motor drive.

In order to generate the axial relative movement of the application members and of the outer mold, various possibilities are offered according to the invention. In a particular embodiment of the invention, an axial movement of the outer mold is performed and in this instance preferably superimposed on a compressing movement of the application members. Due to the mutual superimposition of the compressing movement of the application members and of the axial movement of the outer mold, material of the hollow body wall, plasticised as a result of the compressing movement of the application members, flows into the expansion space of the outer mold, which enlarges continuously due to the axial relative movement of the application members and of the outer mold, where the thickening of the hollow body wall consequently can be built up continuously over the desired axial length.

Once the forming of the hollow body wall is complete, in a preferred embodiment of the invention the thickened hollow body wall, or the hollow body, and the outer mold are separated from one another by a relative movement in the axial direction performed by the thickened hollow body wall, or the hollow body, and the outer mold.

Additionally or alternatively, the thickened hollow body wall or the hollow body is removed from the outer mold by outer mold parts, which are formed by dividing the outer mold in the axial direction, being moved relative to one another in the radial direction so as to open the outer mold. The last-mentioned approach is selected in particular if the geometry of the formed hollow body does not permit the hollow body to be removed from the outer mold solely by a movement in the axial direction.

This is the case for example if the hollow body wall is provided, within the forming process, in the outer mold at the same time or successively with a plurality of thickenings offset relative to one another in the axial direction, in particular with thickenings at both axial ends of the hollow body wall. Once the forming process is complete, the produced thickenings protrude in the radial direction, at both axial ends of the first partial length of the receptacle wall provided on the outer mold, relative to the first partial length of the receptacle wall of reduced cross section compared with the thickenings. Due to the oversize of the cross section of the thickenings of the hollow body wall relative to the cross section of the first partial length of the receptacle for the hollow body wall, the thickenings of the hollow body wall cannot pass through the first partial length of the receptacle for the hollow body wall in either of the two axial movement directions.

For cases of the last-mentioned type, the device according to the invention comprises the outer mold divided in the axial direction. The outer mold parts formed by the division of the outer mold are movable relative to one another in the radial direction, preferably by means of a controllable motor drive. The outer mold can be opened or closed as desired by relative movements of the outer mold parts in the radial direction.

In a further preferred embodiment of the device according to the invention, a first axial outer mold part formed by dividing the outer mold in the radial direction is divided in the axial direction into outer mold parts which are movable relative to one another in the radial direction, preferably by means of a controllable motor drive. The first axial outer mold part comprises the first partial length, of reduced cross section, of the receptacle for the hollow body wall provided on the outer mold. In addition to the first axial outer mold part, a second axial outer mold part results due to the radial division of the outer mold. The second axial outer mold part is formed in one piece and is provided with the expansion space of the outer mold, the expansion space at the second axial outer mold part opening out towards the first axial outer mold part and the wall of the expansion space extending in the axial direction in such a way that the second axial outer mold part and the thickening of the hollow body wall formed in the expansion space are movable relative to one another in the axial direction, with the thickening of the hollow body wall leaving the second axial outer mold part. The two axial outer mold parts are adjacent to one another in the axial direction. Within the two axial outer mold parts, the first partial length of the receptacle wall and the expansion space supplement one another to form the entire receptacle provided for the hollow body wall or the hollow body. Due to the fact that it is formed in one piece, the second axial outer mold part is free from separating joints. This is advantageous insofar as, when thickening a hollow body wall, no separating joints are reproduced undesirably on the thickening of the hollow body wall produced in the expansion space of the outer mold, due to the absence of separating joints. Since merely the expansion space of the receptacle of the outer mold intended to receive the hollow body wall is provided on the second axial outer mold part, i.e. the part of the receptacle that does not have a reduced cross section compared to a thickening of the hollow body wall produced in the expansion space of the outer mold, the formed hollow body can be removed from the second axial outer mold part by a movement in the axial direction.

BRIEF DESCRIPTION OF THE DRAWINGS

The invention will be explained hereinafter in greater detail on the basis of exemplary schematic illustrations, in which:

FIGS. 1A to 4B show the sequence of a first variant of a method for thickening a wall of a hollow shaft in portions, FIGS. 5A to 8B show the sequence of a second variant of a method for thickening the wall of a hollow shaft in portions.

DETAILED DESCRIPTION OF THE EMBODIMENTS

Figure 3B:
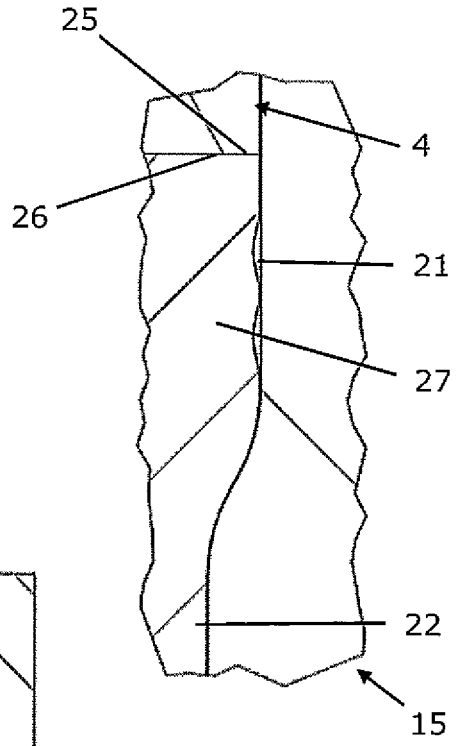
Figure 3A:
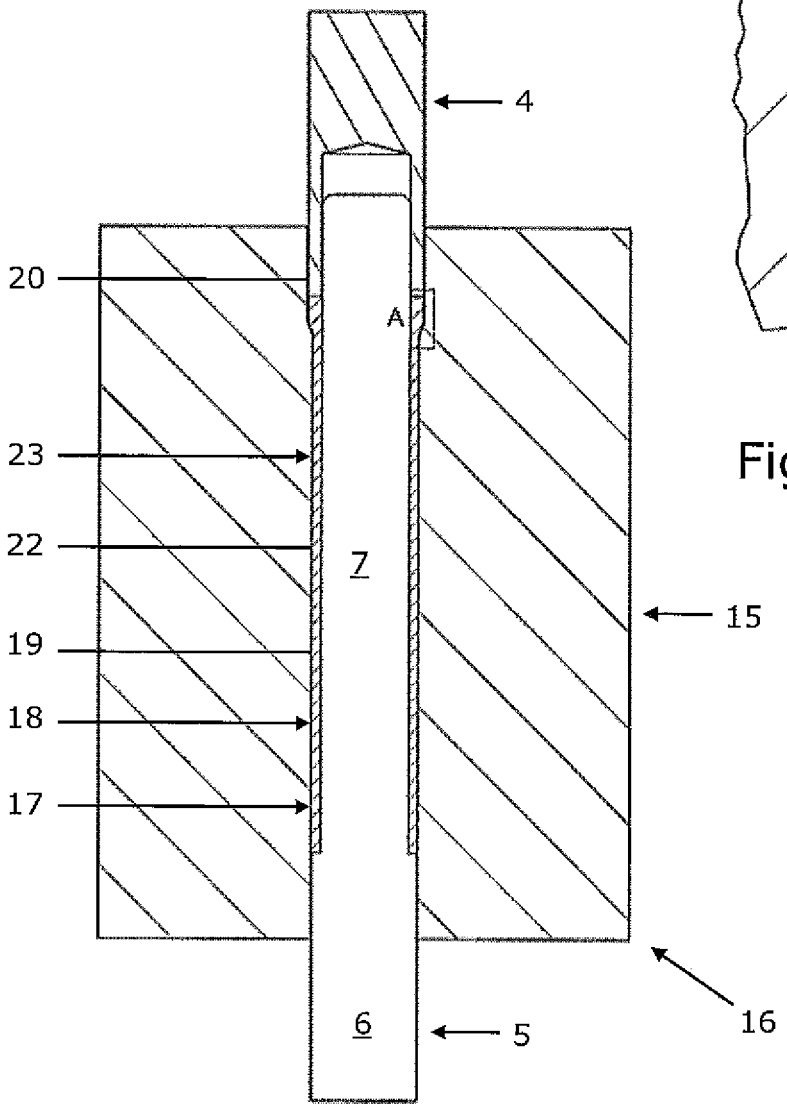

According to FIG. 1A, a machine that is indicated and is configured as a forming machine 1 comprises a first tool holder 2 and a second tool holder 3. A punch 4 is fixed in the first tool holder 2, and the second tool holder 3 holds a processing unit 5, which in turn is formed of a pressure piece 6 and a mandrel 7, which is formed in one piece with the pressure piece 6 and has a reduced cross section compared to the pressure piece 6. The mandrel 7 as well as the pressure piece 6 have a circular cross section. Due to the cross-sectional reduction of the mandrel 7 compared to the pressure piece 6, the pressure piece 6 forms a peripheral shoulder 8.

The punch 4 and the pressure piece 6 of the processing unit 5 form application members, the punch 4 being formed as a hollow member and comprising a punch cavity 9 as the member cavity. The punch cavity 9 as well as the mandrel 7 have a circular cross section. The size of the cross section of the punch cavity 9 exceeds the size of the cross section of the mandrel 7 to a minimal extent.

The punch 4 can be moved along a movement axis 11 by means of a motor drive unit 10. Correspondingly, a motor drive unit 12 is used to move the processing unit 5 along the movement axis 11. Both the motor drive unit 10 and the motor drive unit 12 in the illustrated example are hydraulic drives of conventional design. The motor drive units 10, 12 together form a motor drive 13 for the punch 4 and the processing unit 5 and thus for the pressure piece 6 and the mandrel 7. A programmable numerical control 14 of the motor drive 13 or the motor drive units 10, 12 is depicted suggestively in FIG. 1A.

Together with a reinforcement 15 provided as outer mold, the punch 4 and the processing unit 5 form a forming tool 16. The forming tool 16 is shown in all of FIGS. 1A to 8B, whereas the other parts of the forming machine 1 are depicted only in FIG. 1A, for the sake of simplicity.

The reinforcement 15 comprises a receptacle 17 with a receptacle wall 18. The receptacle wall 18 extends in parallel with the movement axis 11 of the punch 4 and the processing unit 5 and comprises a first partial length 19 and a second partial length 20, which adjoins the first partial length 19 along the movement axis 11 and is radially outwardly offset relative to the first partial length 19, thus widening the receptacle 17. The second partial length 20 of the receptacle wall 18 delimits an expansion space 21 of the reinforcement 15. The relevant drawing detail "A" of FIG. 1A is illustrated in an enlarged view in FIG. 1B.

The forming tool 16 is used as a device for thickening a plastically deformable hollow body wall of a hollow body in portions, in the example shown for thickening a wall 22, in portions, of a hollow shaft 23, the wall 22 consisting of plastically deformable steel. The wall 22 delimits a cavity of the hollow shaft 23, which cavity is circular in cross section. The movement axis 11 coincides with the cavity axis of the cavity and defines an axial direction by means of its course.

FIGS. 1A to 4B illustrate the sequence of a first method, which can be performed by means of the forming machine 1 or by means of the forming tool 16, for thickening the wall 22 of the hollow shaft 23 in portions. Methods modified in comparison to this method will be explained on the basis of FIGS. 5A to 8B and on the basis of FIGS. 9A to 12B. The different method stages are presented here in each case both with an overall view of the forming tool 16 and with an enlarged drawing detail "A". The numbering of the overall views has the addition A; the numbering of the enlarged drawing detail is provided with the addition B.

In the case of the method variants according to FIGS. 1A to 4B and 5A to 8B, the hollow shaft 23 in the undeformed state is firstly slid from the side of the punch 4 in the axial direction (along the movement axis 11) into the receptacle 17 of the reinforcement 15 and in the process is slid onto the mandrel 7 of the processing unit 5 that is already arranged within the receptacle 17. The punch 4 is at this time set back in the axial direction relative to the reinforcement 15. The processing unit 5 assumes the position illustrated in FIGS. 1A and 5A in the axial direction relative to the reinforcement 15.

The wall 22 of the hollow shaft 23 in the illustrated example has a circular ring-shaped cross section. The outer diameter of the wall 22 corresponds to the diameter of the receptacle 17 at the reinforcement 15 and matches the diameter of the pressure piece 6 of the processing unit 5. The inner diameter of the wall 22 corresponds to the diameter of the mandrel 7 of the processing unit 5. The hollow shaft 23 that is slid into the receptacle 17 of the reinforcement 15 therefore rests on the mandrel 7 without play in the radial direction. On the outer side, the wall 22 of the hollow shaft 23 is arranged directly adjacently to the receptacle wall 18 of the receptacle 17. In the axial direction, the hollow shaft 23 rests, via a radial end face 24 of the wall 22, on the shoulder 8 of the pressure piece 6 extending around the movement axis 11.

On the basis of these conditions, the punch 4 is advanced by means of the motor drive 13 or the motor drive unit 10 in the axial direction towards the hollow shaft 23, until a radial end face 25 of the punch 4 comes into contact with a radial end face 26 of the wall 22 of the hollow shaft 23 and the hollow shaft 23 consequently is clamped in the axial direction between the pressure piece 6 or the shoulder 8 of the processing unit 5 on the one hand and the punch 4 on the other hand by a force of small magnitude. The end of the mandrel 7 that is remote from the pressure piece 6 enters the punch cavity 9 in the axial direction as the punch 4 is moved.

The advance movement of the punch 4 performed by the motor drive 13 or the motor drive unit 10 can be both path-controlled and force-controlled by the numerical control 14. In the case of path-dependent control, the punch 4 is moved, starting from its initial position, over a 35, defined path length in the axial direction. In the case of force-dependent control, the rise in force in the drivetrain of the punch 4, which results when the radial end face 25 of the punch 4 strikes the radial end face 26 of the wall 22 of the hollow shaft 23, marks the end of the advance movement.

The described advance movement of the punch 4 is performed both in the method according to FIGS. 1A to 4B and in the method according to FIGS. 5A to 8B. The conditions resulting at the end of the advance movement of the punch 4 are illustrated in FIGS. 1A, 1B and in FIGS. 5A, 5B. The subsequent method steps differ from one another.

In the method according to FIGS. 1A to 4B, starting from the conditions according to FIGS. 1A and 1B, a compressing movement in the axial direction is performed by the punch 4 and the pressure piece 6 by the pressure piece 6 being moved in the axial direction towards the punch 4, which is stationary in the axial direction. Due to the compressing movement, material of the wall 22 of the hollow shaft 23 is plasticised between the application points at the wall 22, i.e. between the radial end faces 24, 26 of the wall 22, and plasticised material of the wall 22 flows into the expansion space 21 of the reinforcement 15 that is arranged between the application points or between the radial end faces 24, 26 of the wall 22. Any other material flow is prevented at the inner side of the wall 22 by the mandrel 7, which functions as an inner supporting body for the wall 22 of the hollow shaft 23 and which, with its axis-parallel lateral surface, forms a supporting body face or an inner supporting face for the wall 22 and by means of this face supports the wall 22 of the hollow shaft 23 in the radial direction. The first partial length 19 of the receptacle wall 18 acts accordingly on the outer side of the wall 22. The first partial length 19 of the receptacle wall 18 forms an outer supporting face for the wall 22 which outer supporting face extends in parallel with the wall 22 and accordingly supports the wall 22 of the hollow shaft 23 likewise in the radial direction.

The compressing movement, i.e. the movement performed in the axial direction by the pressure piece 6 relative to the stationary punch 4 of the forming tool 16, ends as soon as the expansion space 21 of the reinforcement 15 is filled with plasticised material of the wall 22, thus forming a thickening 27 of the wall 22, and therefore the method stage according to FIGS. 2A and 2B is reached.

Both path control and force control are also conceivable for the described compressing movement of the punch 4 and of the pressure piece 6. For path control, it is necessary to store a movement path length of the pressure piece 6, for example determined empirically, in the numerical control 14 of the motor drive 13. As soon as the pressure piece 6 has moved in the axial direction over the predefined path length, the motor drive unit 12 used for the movement of the pressure piece 6 is stopped.

In the case of a force control of the compressing movement, the motor drive unit 12 for the pressure piece 6 is switched off as soon as the rise in motor driving force, which is produced when the expansion space 21 of the reinforcement 15 is filled with plasticised material of the wall 22 and a further advance of the hollow shaft 23 in the axial direction is consequently blocked, is detected by means of a corresponding sensor system on the motor drive unit 12.

Proceeding from the method stage according to FIGS. 2A and 2B, the punch 4 is moved back, by means of the motor drive unit 10, relative to the radial end face 26 of the wall 22 of the hollow shaft 23 in the axial direction in a path-controlled manner by the path length over which the thickening 27 of the wall 22 is to be lengthened in the axial direction in the subsequent forming process.

Once the punch 4 has reached its target position in the axial direction, the motor drive unit 10 is stopped and a new compressing movement is performed in the above-described way by means of the motor drive unit 12. Here, the pressure piece 6 is again advanced in the axial direction in a path-controlled or force-controlled manner relative to the punch 4, which is stationary in this direction, by means of the motor drive unit 12 until the expansion space 21 of the reinforcement 15 that has been enlarged due to the prior retracting movement of the punch 4 is filled again completely with plasticised material of the wall 22 of the hollow shaft 23 and therefore the conditions according to FIGS. 3A and 3B have been provided.

The described process is repeated until the thickening 27 produced at the wall 22 of the hollow shaft 23 has the desired length in the axial direction. During the entire compressing movement, which is performed intermittently, the pressure piece 6 is guided via the mandrel 7 in the axial direction in the interior of the punch cavity 9. In the illustrated example, a thickening 27, which extends in a wave-like manner on the outer side in the axial direction, is built up on the wall 22 of the hollow shaft 23 in the expansion space 21 of the reinforcement 15. With each of the compression strokes of the compressing movement performed by the punch 4 and the pressure piece 6, one of the axial wave portions of the thickening 27 is produced. The wave shape can be smoothed as necessary by a subsequent secondary processing following on from the forming process.

Figures 4A, 4B:
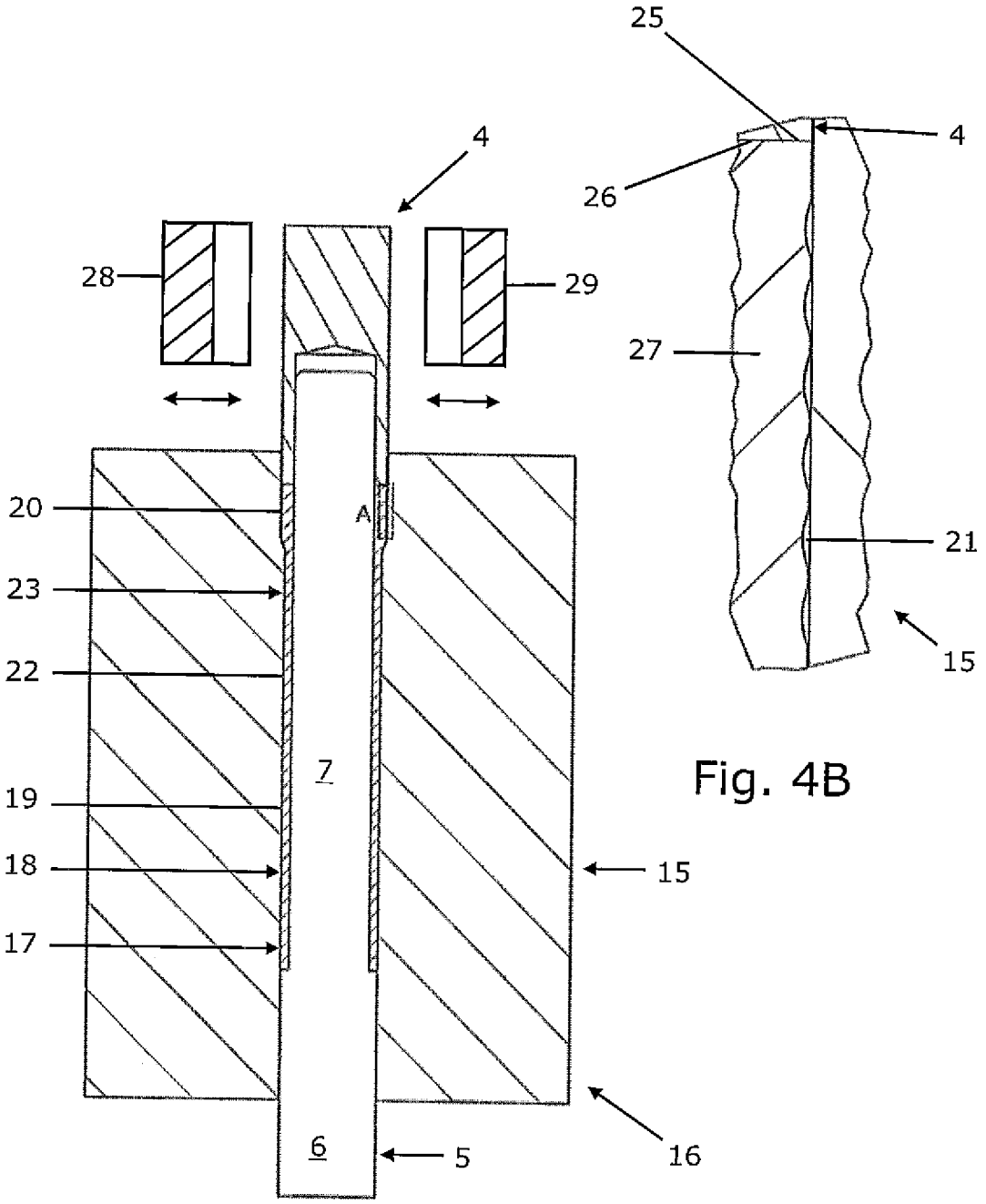

Proceeding from the conditions at the end of the forming process illustrated in FIGS. 4A and 4B, the punch 4 is moved back rapidly in the axial direction relative to the reinforcement 15 into the initial position which it assumed prior to the start of the forming process. At the same time as the movement of the punch 4, or subsequently thereto, the processing unit 5 is advanced in the axial direction together with the hollow shaft 23 that rests on the mandrel 7 by actuating the motor drive unit 12, until the hollow shaft 23 is arranged at least partially outside the reinforcement 15 and is thus accessible for removal from the forming tool 16.

Also removing the formed hollow shaft 23 can be performed mechanically. For this purpose, clamping shells 28, 29 can be used, as illustrated highly schematically in FIG. 4A. The clamping shells 28, 29 can be moved in the radial direction of the formed hollow shaft 23 in the direction of double-headed arrows illustrated in FIG. 4*a* by means of a corresponding numerically controlled drive.

If the formed hollow shaft 23 is sufficiently pushed out of the reinforcement 15 in the axial direction by means of the motor drive unit 12, the clamping shells 28, 29 are moved towards one another in the radial direction of the hollow shaft 23 until they clamp the hollow shaft 23 behind the thickening 27. By actuating the motor drive unit 12 is the processing unit 5 now moved back in the axial direction and the mandrel 7 thus removed from the interior of the hollow shaft 23. Once the mandrel 7 has left the cavity of the hollow shaft 23, the formed hollow shaft 23 can be removed from the forming machine 1 by means of the clamping shells 28, 29. For this purpose, the clamping shells 28, 29 can be movable in the axial direction and/or pivotable. With a corresponding movement of the clamping shells 28, 29 in the opposite direction, an as yet undeformed hollow shaft can then be introduced into the forming machine 1 or the forming tool 16 in order to start a further forming process of the above-described type.

Within the method according to FIGS. 5A to 8B, a compressing movement is first performed, starting from the conditions according to FIGS. 5A and 5B, by the pressure piece 6 being moved in the axial direction relative to the punch 4, which is stationary in the axial direction, by means of the motor drive unit 12. If, as a result of the relative movement of the pressure piece 6 and of the punch 4, the expansion space 21 of the reinforcement 15 has become filled with plasticised material of the wall 22 of the hollow shaft 23, thus forming the thickening 27, the motor drive unit 12 is not now stopped and the punch 4 is not retracted relative to the radial end face 26 of the wall 22 of the hollow shaft 23.

Instead, as soon as the expansion space 21 of the reinforcement 15 has been filled for the first time with plasticised material of the wall 22 and the method stage according to FIGS. 6A and 6B has been reached accordingly, a movement of the punch 4 in the axial direction is initiated in addition to the movement of the pressure piece 6 already underway. The additional movement of the punch 4 is triggered either in a path-controlled manner as soon as the pressure piece 6 has moved over a defined path length in the axial direction starting from its initial position, or in a force-controlled manner as soon as the expansion space 21 of the reinforcement 15 has been filled with plasticised material of the wall 22 and consequently a rise of the forming force applied by means of the motor drive unit 12 has been detected.

The joint movement of the punch 4 and of the pressure piece 6 seamlessly follows the first movement phase, in which only the pressure piece 6 is moved in the axial direction.

In the phase of the compressing movement in which the punch 4 and the pressure piece 6 are moved together in the axial direction, the punch 4 and the pressure piece 6 move in the same direction, but the pressure piece 6 is moved at a higher speed than the punch 4. As a result of the speed difference, a compressive force is exerted by means of the punch 4 and the pressure piece 6 onto the wall 22 of the hollow shaft 23 in the axial direction, due to which compressive force some material of the wall 22 is plasticised. Since the punch 4 and the pressure piece 6 move together in the axial direction and since this movement is performed relative to the reinforcement 15, which is stationary in the axial direction, the expansion space 21 of the reinforcement 15, which expansion space is delimited by the punch 4, becomes larger during the compressing movement. The extent of the expansion space 21 increases in the axial direction. Plasticised material of the wall 22 flows continuously into the expansion space 21. In this way, the thickening 27 is created over the desired axial length at the relevant axial end of the wall 22 of the hollow shaft 23. Here, the wall 22 is supported in the radial direction on its inner side by the mandrel 7 and on its outer side by the first partial length 19 of the receptacle wall 18.

The relative movement of the punch 4 and of the pressure piece 6, which is performed as a continuous compressing movement, and the relative movement between the punch 4 and the pressure piece 6 on the one hand and the reinforcement 15, which is stationary in the axial direction, on the other hand, which relative movement is performed at the same time as the compressing movement, are controlled in such a way that the expansion space 21 of the reinforcement 15 that becomes longer in the axial direction during the course of the forming process is permanently completely filled with plasticised material of the wall 22. Consequently, the thickening 27 is produced over its entire axial length having an axis-parallel outer face that is flat in the axial direction and reproduces the wall of the expansion space 21 exactly.

In FIGS. 7A and 7B, the thickening 27 on the wall 22 of the hollow body 23 is lengthened in the axial direction compared to the conditions according to FIGS. 6A and 6B, but the final length of the thickening 27 has not yet been reached. With its final axial length, the thickening 27 at the relevant axial end of the wall 22 of the hollow shaft 23 is shown in FIGS. 8A and 8B.

Upon reaching the method stage according to FIGS. 8A and 8B, the speed of the punch 4 is increased by correspondingly controlling the motor drive unit 10 in such a way that the speed of the punch 4 exceeds the speed of the pressure piece 6. Consequently, the punch 4 lifts off with its radial end face 25 from the radial end face 26 of the wall 22 and moves rapidly into its initial position remote from the reinforcement 15 in the axial direction. At the same time, the formed hollow shaft 23 is pushed out of the reinforcement 15 by the processing unit 5, which continues its movement in the axial direction unchanged. The hollow shaft 23 that is arranged outside the reinforcement 15 can be grasped in the above-described way by means of the clamping shells 28, 29 (not illustrated in FIGS. 8A and 8B) and can be removed from the forming tool 16 or from the forming machine 1. A hollow shaft 23 that is to be processed can then be fed to the forming tool 16 by means of the clamping shells 28, 29.

In a deviation from the approach according to FIGS. 1A to 4B and according to FIGS. 5A to 8B, an axial movement performed by the reinforcement 15 in the axial direction relative to the punch 4 and the pressure piece 6 can be superimposed on the compressing movement performed by the punch 4 and the pressure piece 6. When the axial movement of the reinforcement 15 is appropriately controlled, the extent of the expansion space 21 at the reinforcement 15 increases in the axial direction, and the thickening 27 on the wall 22 of the hollow shaft 23 that builds up due to the compressing movement of the punch 4 and of the pressure piece 6 can lengthen in the axial direction.

The method illustrated in FIGS. 9A to 12B coincides in terms of its primary sequences with the method according to FIGS. 1A to 4B and according to FIGS. 5A to 8B. According to FIGS. 9A to 12B as well, a wall 22 of a hollow shaft 23 is plasticised by a compressing movement of a punch 4 and of a pressure piece 6 that is performed along a movement axis 11 in an axial direction, and plasticised material of the wall 22 builds up a thickening 27.

In a deviation from the method according to FIGS. 1A to 4B and 5A to 8B, a thickening 27 is produced at both axial ends of the wall 22 or the hollow body 23 within the method according to FIGS. 9A to 12B. For this purpose, a forming tool 30 is used according to FIGS. 9A to 12B, which forming tool, although it does not differ fundamentally from the forming tool 16 of FIGS. 1A to 8B, does differ therefrom in terms of design details.

Figure 9A:
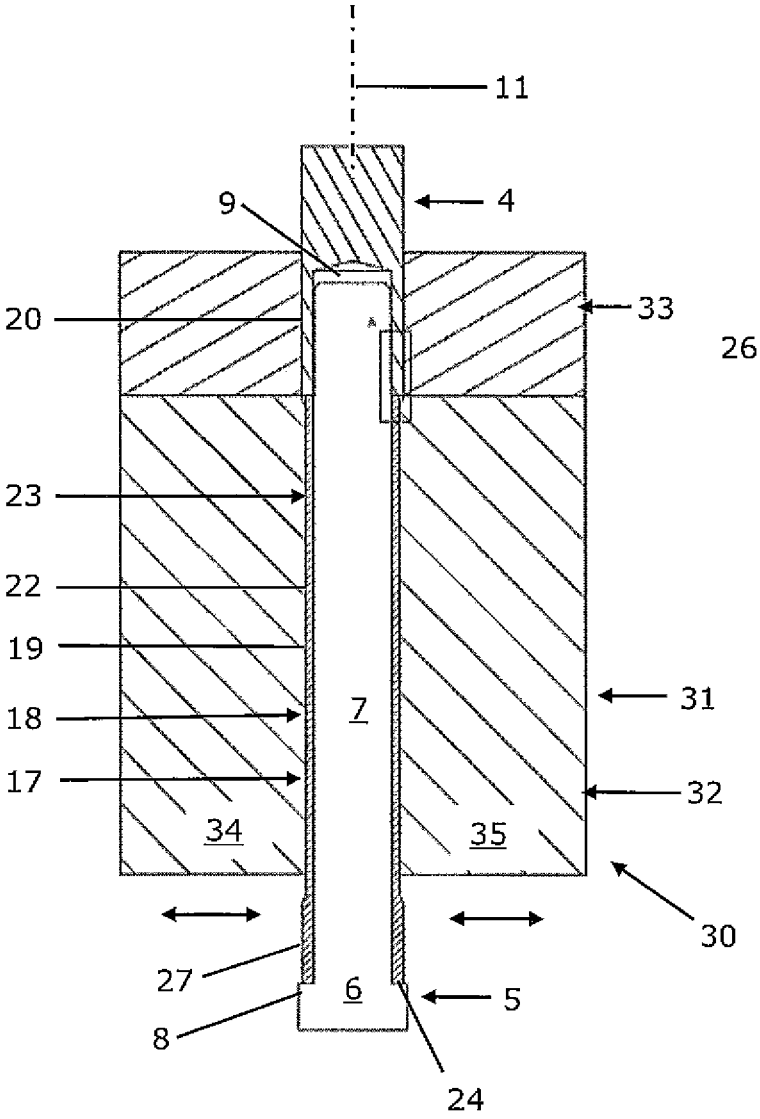
FIGS. 9A to 12B show the sequence of a third variant of a method for thickening a wall of a hollow shaft in portions.

Unlike the forming tool 16 according to FIGS. 1A to 8B, the forming tool 30 has a multi-part reinforcement 31 as outer mold. The reinforcement 31 is divided both in the radial direction and in the axial direction. Due to the division in the radial direction, the reinforcement 31 comprises a first axial outer mold part in the form of a first reinforcement unit 32 and a second axial outer mold part in the form of a second reinforcement unit 33. The first reinforcement unit 32 is in turn divided in the axial direction so as to form two lateral outer mold parts or reinforcement parts 34, 35. In FIG. 9A, the separating joint between the two lateral reinforcement parts 34, 35 of the first reinforcement unit 32 extends along the movement axis 11 perpendicularly to the drawing plane. Dividing the first reinforcement unit 32 into more than two outer mold parts or reinforcement parts, in particular into four or six lateral outer mold parts or reinforcement parts, is conceivable.

The second reinforcement unit 33 of the reinforcement 31 is formed in one piece.

Of the receptacle 17, provided on the reinforcement 31, for the wall 22 of the hollow shaft 23, only the part of the expansion space 21, the wall of which extends axis-parallel in the axial direction, is arranged on the second reinforcement unit 33. The first reinforcement unit 32 comprises the first partial length 19 of the receptacle wall 18 and a transition region between the first partial length 19 of the receptacle wall 18 and the part of the expansion space 21 that is provided on the second reinforcement unit 33. By means of a numerically controlled motor actuator of conventional design (not shown), the lateral reinforcement parts 34, 35 of the first reinforcement unit 32 can be moved or positioned relative to one another in the radial direction in order to open and close the reinforcement 31. In FIG. 9A, the relative movability of the lateral reinforcement parts 34, 35 is indicated by double-headed arrows.

Figure 9B:
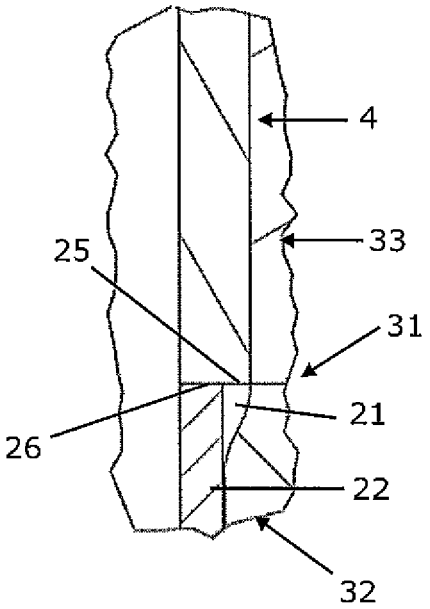
Figure 10A:
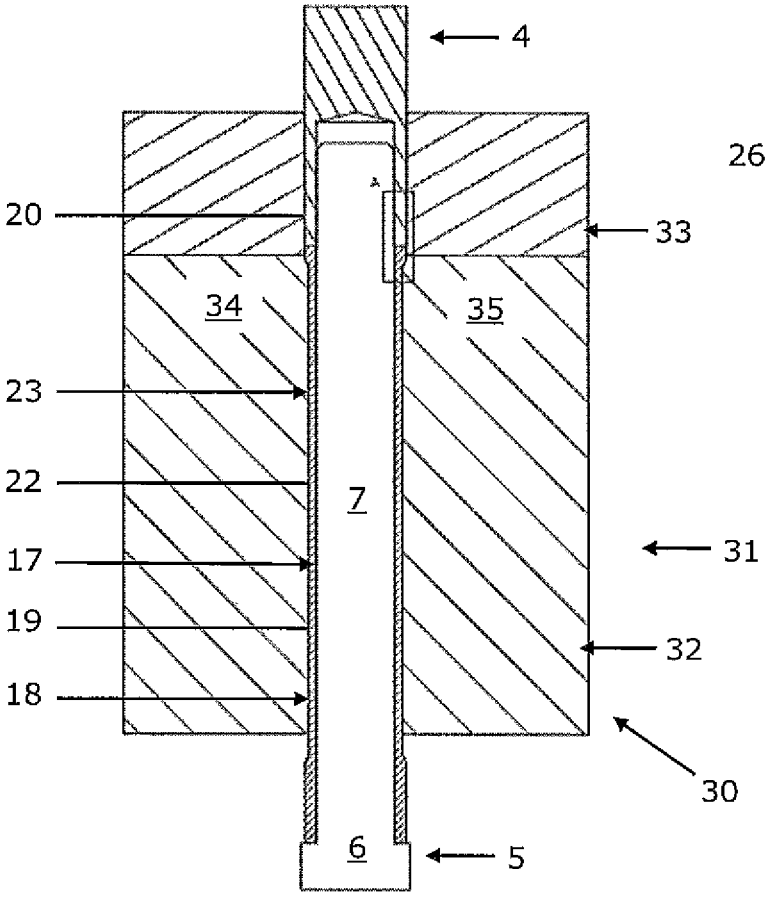
Figure 10B:
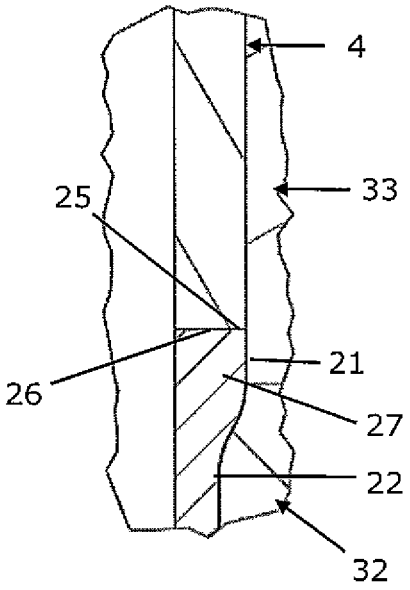
Figure 11A:
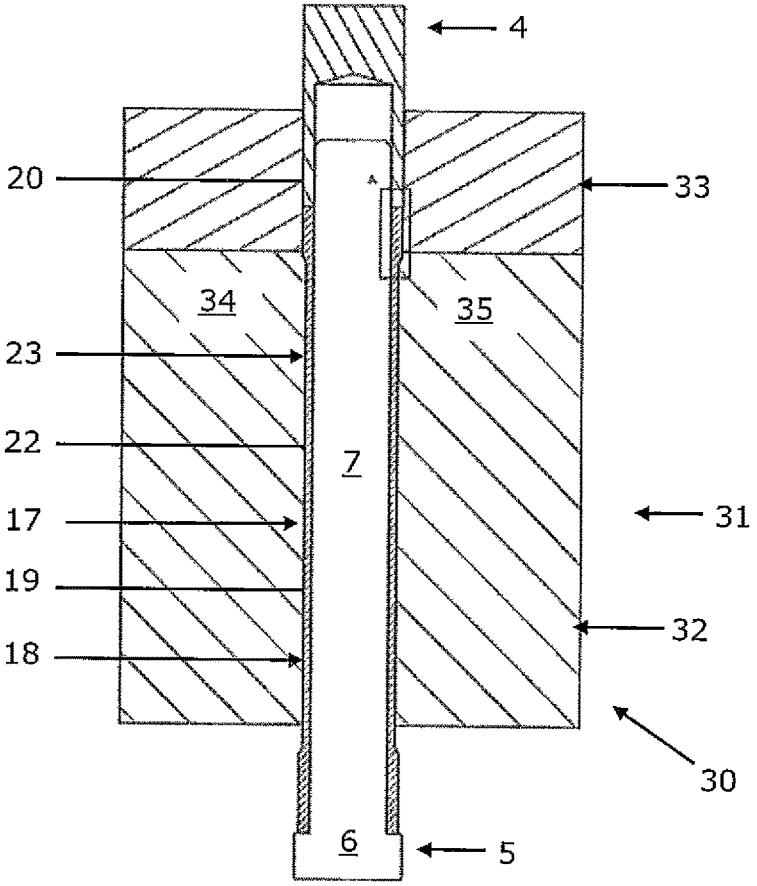
Figure 11B:
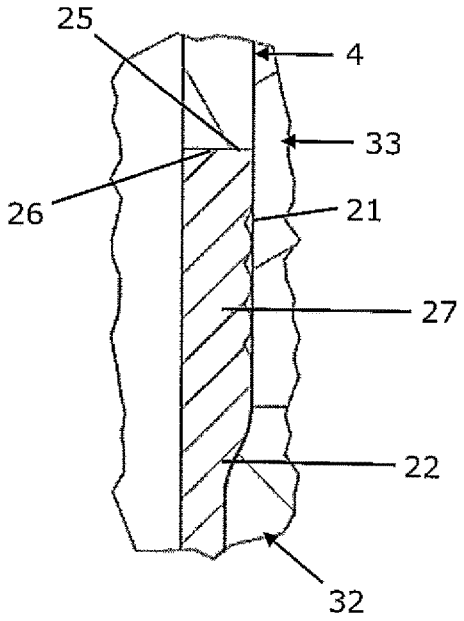
Figure 12A:
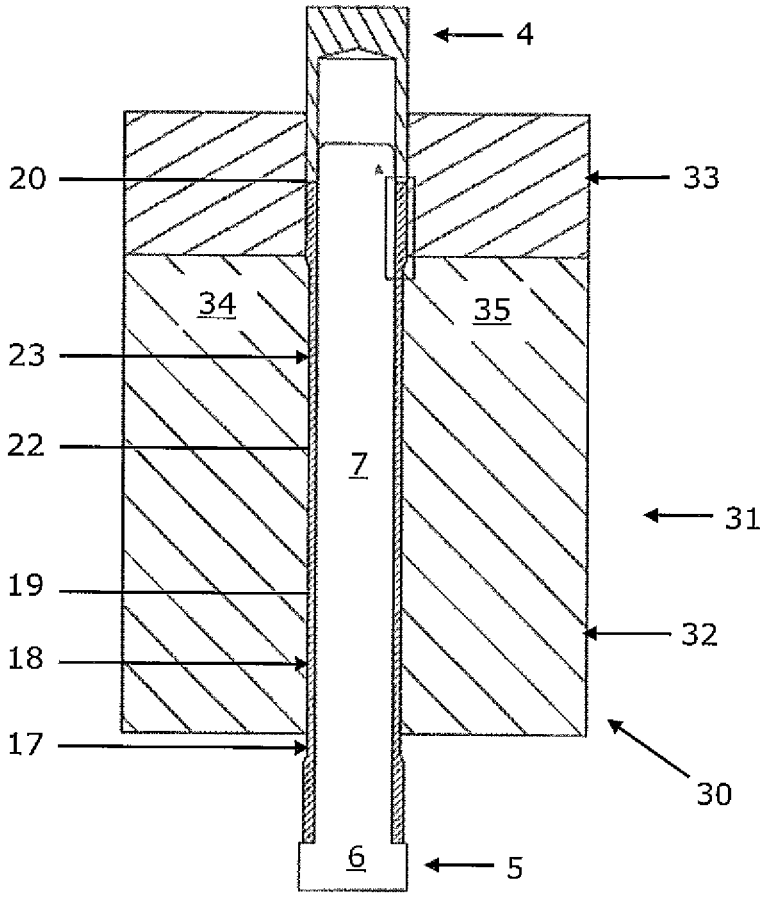
Figure 12B:
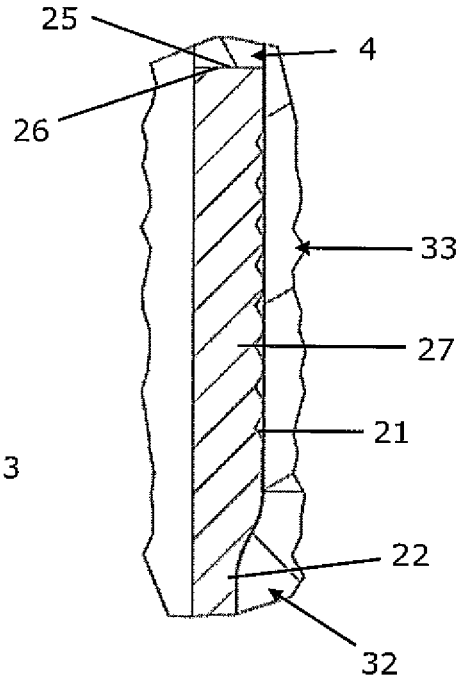

In the stage illustrated in FIGS. 9A and 9B of the forming method that is performed by means of the forming tool 30, a thickening 27 has already been produced at an axial end of the hollow shaft 23. The relevant forming process corresponded to one of the methods explained above in relation to FIGS. 1A to 4B and 5A to 8B in terms of its sequence. The multi-part forming tool 30 was used here in the same way as the one-part forming tool 16 of FIGS. 1A to 8B.

Once the thickening 27 was completed, the punch 4 of the forming tool 30 was moved in the axial direction into a position away from the reinforcement 31. The hollow shaft 23 provided with the thickening 27 was then removed from the reinforcement 31. For this purpose, the mandrel 7 was firstly moved out of the interior of the hollow shaft 23 (downwardly in FIG. 9A) by a corresponding axial movement of the processing unit 5. The hollow shaft 23 was supported on the upper side of the first reinforcement unit 32 by the thickening 27 protruding in the radial direction relative to the first partial length 19 of the receptacle wall 18. The lateral reinforcement parts 34, 35 of the first reinforcement unit 32 were then moved away from one another in the radial direction to such an extent that it was possible to remove the thickening 27 in the axial direction out of the expansion space 21 at the second reinforcement unit 33, and that the hollow shaft 23 with the thickening 27 could pass through the first reinforcement unit 32 with a movement in the axial direction. The hollow shaft 23 was then rotated through 180 degrees outside the reinforcement 31 and was slid onto the mandrel 7 of the processing unit 5, with the thickening 27 formed at one end leading. Together with the hollow shaft 23 resting on the mandrel 7 and supported in the axial direction on the pressure piece 6, the processing unit 5 was then slid in the axial direction into the first reinforcement unit 32, which was still open. The first reinforcement unit 32 was then closed by a corresponding relative movement of the lateral reinforcement parts 34, 35 in the radial direction. Lastly, the hollow shaft 23 formed at one end was clamped in the axial direction with a force of small magnitude between the pressure piece 6 or the shoulder 8 of the processing unit 5 on the one hand and the punch 4 on the other hand by means of a movement of the punch 4 of the forming tool 30. This then resulted in the conditions according to FIGS. 9A and 9B.

Proceeding from these conditions, a thickening 27 of the wall 22 is produced at the second axial end of the hollow shaft 23 according to the method described above in relation to FIGS. 1A to 4B and illustrated in FIGS. 10A to 12B. Alternatively, the method according to FIGS. 5A to 8B could also be used in order to produce the second thickening 27 of the wall 22 of the hollow shaft 23.

Once the second thickening 27 has been produced, the hollow shaft 23 is removed out of the reinforcement 31 and then transported away from the forming tool 30 or the forming machine 1. The sequences with regard to the removal of the hollow shaft 23 with the wall 22 formed at both ends correspond to the sequences, described above in detail, with regard to the removal of the hollow shaft 23 that is formed only at one axial end.

Both the hollow shaft 23 formed at one end and the hollow shaft 23 formed at both axial ends can be subjected to secondary processing within a manufacturing method. In particular, it is conceivable that particular functional elements, such as a thread or gear teeth, are produced on the thickening(s) 27 of the wall 22 of the hollow shaft 23.

What is claimed is:

1. A method for thickening a plastically deformable hollow body wall of a hollow body, the hollow body wall extending in an axial direction along a cavity axis of a cavity of the hollow body, which cavity is delimited by the hollow body wall, comprising the following steps:

arranging the hollow body in a receptacle of an outer mold, said receptacle having a receptacle wall that extends in the axial direction on an outer side of the hollow body wall and forms, by means of a first partial length that extends in the axial direction, an outer supporting face, extending in parallel with the hollow body wall, and delimiting, by means of a second partial length that extends in the axial direction, an expansion space of the outer mold, the second partial length of the receptacle wall being offset radially outwardly relative to the first partial length of the receptacle wall, thus forming a widened region of the receptacle to create an expansion space, arranging an inner supporting body on the inner side of the hollow body wall in such a way that the inner supporting body forms, with a supporting body face extending on the inner side of the hollow body wall in the axial direction, an inner supporting face for the hollow body wall, the inner supporting face of the inner supporting body being arranged in the axial direction at a level of the outer supporting face and also at a level of the expansion space of the outer mold, and applying a compressive force by means of only two application members at application points in the axial direction to the hollow body, with effective radial support of the hollow body wall on the outer supporting face of the outer mold and with effective radial support of the hollow body wall on the inner supporting face of the inner supporting body, such that the application members are moved towards one another in the axial direction with a continuous compressing movement, the application points on the hollow body being distanced from one another in the axial direction, the expansion space of the outer mold being arranged between the application points, and an application member protruding radially outwardly relative to the outer side of the hollow body wall and delimiting the expansion space of the outer mold in the axial direction, wherein due to the continuous compressing movement of the application members, material of the hollow body wall between the application points is plasticised in the region of the expansion space of the outer mold, and plasticised material of the hollow body wall flows into the expansion space of the outer mold, thus thickening the hollow body wall, wherein in addition to and simultaneously with the continuous compressing movement of the application members an axial relative movement of the application members performing the continuous compressing movement and of the outer mold is performed in the axial direction during the step of applying a compressive force, wherein the application members, performing the continuous compressing movement, axially move jointly and in the same direction relative to the outer mold during the axial relative movement by an axial movement of the outer mold in the axial direction being performed at the same time as and, thus, temporally superimposed on the continuous compressing movement performed by the application members or by the application members, performing the continuous compressing movement, moving relative to the outer mold, which is stationary in the axial direction, and wherein an extent of the expansion space of the outer mold in the axial direction increases due to the axial relative movement of the application members performing the continuous compressing movement and of the outer mold.

2. The method according to claim 1, wherein the continuous compressing movement of the application members is path-controlled and/or force-controlled.

3. The method according to claim 1, wherein at least one of the application points is an end radial face of the hollow body.

4. The method according to claim 1, wherein at least one of the application members is formed in one piece with the inner supporting body.

5. The method according to claim 1, wherein one of the application members is formed as a hollow member and is provided with a member cavity that extends in the axial direction and is open at least towards the inner supporting body and is configured to receive the inner supporting body.

6. The method according to claim 1, further comprising the step of removing the thickened hollow body wall from the outer mold by a relative movement performed by the thickened hollow body wall and the outer mold in the axial direction.

7. A method for providing a hollow body having a hollow body wall with a plurality of thickenings that are offset from one another in the axial direction, by performing the method of claim 1 at successive regions in the hollow body wall.

8. The method according to claim 1, further comprising the step of removing the thickened hollow body wall from the outer mold by moving outer mold parts relative to one another in the radial direction so as to open the outer mold, said outer mold parts being formed by dividing the outer mold in the axial direction.

9. The method according to claim 7, further comprising the step of removing the thickened hollow body wall from the outer mold by moving the outer mold parts relative to one another in a radial direction so as to open the outer mold, said outer mold parts being formed by dividing the outer mold in the axial direction.

10. A manufacturing method for producing a hollow body having a hollow body wall that delimits a cavity and extends in an axial direction along a cavity axis of the cavity, wherein the hollow body wall is thickened by the method according to claim 1 to provide a thickening over a length extending in the axial direction.

11. The manufacturing method according to claim 10, wherein the hollow body is a hollow shaft forming a steering shaft.

12. The manufacturing method according to claim 10, wherein the thickening of the hollow body wall is provided with at least one functional element.

13. The manufacturing method according to claim 12, wherein the functional element is a toothing or a thread.

* * * * *